US008763592B2

(12) United States Patent
Rampone

(10) Patent No.: US 8,763,592 B2
(45) Date of Patent: Jul. 1, 2014

(54) EGR VALVE ASSEMBLY FOR INTERNAL COMBUSTION ENGINES

(75) Inventor: Domenico Rampone, Asti (IT)

(73) Assignee: GM Global Technology Operations LLC, Detroit, MI (US)

( * ) Notice: Subject to any disclaimer, the term of this patent is extended or adjusted under 35 U.S.C. 154(b) by 303 days.

(21) Appl. No.: 13/271,944

(22) Filed: Oct. 12, 2011

(65) Prior Publication Data

US 2012/0090583 A1 Apr. 19, 2012

(30) Foreign Application Priority Data

Oct. 12, 2010 (GB) ..... 1017134.6

(51) Int. Cl.
*F02M 25/07* (2006.01)
*F02B 47/08* (2006.01)

(52) U.S. Cl.
CPC ..... *F02M 25/0773* (2013.01); *F02M 25/0704* (2013.01); *F02M 25/07* (2013.01)
USPC ..... 123/568.18; 123/568.17

(58) Field of Classification Search
CPC F02M 25/0773; F02M 25/07; F02M 25/0704
USPC ..... 123/568.11, 568.12, 568.15, 568.18, 123/568.21, 568.24, 568.26, 559.1, 563; 701/108; 60/605.1, 605.2, 280
See application file for complete search history.

(56) References Cited

U.S. PATENT DOCUMENTS

| | | | | |
|---|---|---|---|---|
| 4,222,356 | A * | 9/1980 | Ueda et al. | 123/568.18 |
| 6,135,415 | A * | 10/2000 | Kloda et al. | 251/129.11 |
| 6,948,483 | B2 * | 9/2005 | Veinotte | 123/568.18 |
| 2003/0168111 | A1 | 9/2003 | Koga et al. | |
| 2004/0177839 | A1 | 9/2004 | Veinotte | |
| 2007/0068500 | A1 * | 3/2007 | Joergl et al. | 123/568.24 |

FOREIGN PATENT DOCUMENTS

| | | | |
|---|---|---|---|
| DE | 0736683 | A2 | 10/1996 |
| DE | 10139994 | A1 | 3/2003 |
| EP | 1342908 | A2 | 9/2003 |
| EP | 2133548 | A1 | 12/2009 |
| FR | 2926125 | A1 | 7/2009 |
| JP | 2006152843 | A | 6/2006 |

* cited by examiner

*Primary Examiner* — Mahmoud Gimie
(74) *Attorney, Agent, or Firm* — Ingrassia Fisher & Lorenz, P.C.

(57) ABSTRACT

An EGR valve assembly is provided for an Internal Combustion Engine. The valve assembly includes, but is not limited to a duct having an inlet and an outlet. A portion of the duct is configured with an open section that defines a seat for a valve housing, the valve housing having a passage that leads into the duct and a valve flap for opening and closing the passage, and an engaging portion configured to seal the open section of the duct.

16 Claims, 5 Drawing Sheets

EGR VALVE ASSEMBLY FOR INTERNAL COMBUSTION ENGINES

CROSS-REFERENCE TO RELATED APPLICATION

This application claims priority to British Patent Application No. 1017134.6, filed Oct. 12, 2010, which is incorporated herein by reference in its entirety.

TECHNICAL FIELD

The technical field relates to an EGR valve assembly for internal combustion engines.

BACKGROUND

A turbocharged Diesel engine system generally comprises a Diesel engine having an intake manifold and an exhaust manifold, an external air conduit for conveying fresh air from the environment into an intake line leading to the intake manifold, an exhaust line for conveying the exhaust gas from the exhaust manifold to the environment, and a turbocharger which comprises a compressor located in the intake line for compressing the air stream flowing therein, and a turbine located in the exhaust line for driving said compressor. The turbocharged Diesel engine system further comprises an intercooler, also called a charge air cooler, located in the intake line downstream the compressor, for cooling the air stream before it reaches the intake manifold, and a Diesel Oxidation Catalyst (DOC) located in the exhaust line downstream the turbine, for degrading residual hydrocarbons and carbon oxides contained in the exhaust gas. The turbocharged Diesel engine systems can also be equipped with a Diesel Particulate Filter (DPF) located in the exhaust line downstream the DOC, for capturing and removing diesel particulate matter (soot) from the exhaust gas.

In order to reduce the polluting emission, most turbocharged Diesel engine system currently comprises an exhaust gas recirculation (EGR) system, for selectively routing back a part of the exhaust gas from the exhaust manifold into the intake manifold. The exhaust gas mixed with the fresh induction air is aspired into the engine cylinders, in order to reduce the production of oxides of nitrogen ($NO_x$) during the combustion process. Conventional EGR systems comprise an high pressure EGR conduit, also known as short route EGR, for fluidly connecting the exhaust manifold with the intake manifold, an EGR cooler for cooling the exhaust gas before mixing it with the induction air, valve means for regulating the flow rate of exhaust gas through the EGR conduit, and an Electronic Control Unit (ECU) based on a microprocessor for determining the required amount of exhaust gas to be recirculated and for controlling said valve means accordingly.

In order to further reduce the NOx emission, improved EGR systems comprise also an additional Low Pressure EGR (LPE) conduit, also known as long route EGR, which fluidly connects the exhaust line downstream the DPF with the intake line upstream the compressor, an additional EGR cooler located in the additional EGR conduit, and additional valve means for regulating the flow rate of exhaust gas through the additional EGR conduit. These valve means, in particular, are three ways valves that regulate the air flow coming from the environment air and exhaust gas recirculating flow into the engine system. While low pressure EGR conduit systems have several benefits, as explained above, they also raise the complexity of the engine structure and give rise to a certain number of technical problems. Such problems are relatively important in small Diesel engine due, for example, to the space constraints that necessarily arise in such systems.

Also, it must be considered that the three way long route EGR valve is the connection point between an air filter that filters environmental air entering into the engine system and the compressor and the long route EGR cooler, wherein the compressor and the long route EGR cooler are however rigidly fixed on the engine. Known three-ways EGR valve arrangements may comprise an air pipe having an inlet connected to the outlet of the air filter and an outlet connected to a three-way EGR valve which in turn is connected to the inlet of the compressor. This known arrangement raise the problem that high vibration arise due to the rigid connection between the three way long route EGR valve and compressor and to components downstream of the compressor. These vibrations may cause compressor cracks and fluid leakages due to high connection stresses.

At least one aim is to provide for a long route EGR valve assembly for internal combustion engines that provides a damping effect in the region between the vehicle chassis and the compressor connected to the engine thus effectively reducing vibrations. At least a further aim is to provide a long route EGR valve assembly for internal combustion engines that can be easily adapted for different engine applications. At least another aim is to meet these goals by means of a rational and low cost solution. In addition, other aims, desirable features and characteristics will become apparent from the subsequent summary and detailed description, and the appended claims, taken in conjunction with the accompanying drawings and this background.

SUMMARY

An embodiment provides for an EGR valve assembly for an Internal Combustion Engine, the valve assembly comprising a duct having an inlet and an outlet. A portion of the duct is configured with an open section that defines a seat for a valve housing, the valve housing having a passage that leads into the duct and a valve flap for opening and closing the passage, and an engaging portion configured to seal the open section of the duct. This embodiment has the advantage that the air duct may be configured in different shapes to adapt to different air quantity requirements and different engine space requirements and, at the same time, it provides a seat to receive a long route EGR valve.

In another embodiment, the engaging portion of the valve housing comprises a first wing and an opposing second wing that configure a part of the open section of the duct. This embodiment has the advantage that the housing of the valve contributes to define a sealed portion of the air duct.

In a further embodiment of the EGR valve assembly, the EGR valve housing accommodates an actuator for actuating the valve flap.

In still another embodiment of the EGR valve assembly, the EGR valve housing further accommodates a series of gears connecting the actuator to the valve flap in order to actuate it. This embodiment has the advantage of a single standard housing that can be designed for different ducts having different shapes and length in such a way to connect all valve actuating components to the duct.

In another embodiment, a position sensor is provided to measure the position of the valve flap. Advantageously, this embodiment allows for controlling the flow rate of the EGR valve by means of the ECU of the engine.

In a further embodiment, the valve housing comprises a first flange connected to a second flange of the duct. This embodiment advantageously allows for an easy mounting of the valve assembly.

In still another embodiment, the duct is equipped with a seat for a Mass Air Flow (MAF) sensor. This embodiment advantageously allows for a better integration of the MAF sensor component into the vale assembly.

In another embodiment the duct is at least partly made of plastic material. An advantage of this embodiment is that the plastic material of the air duct offers a damping effect between the engine components and the vehicle chassis. Also, the use of a plastic material reduces valve weight.

An intake line is also provided for an Internal Combustion Engine comprising a long route EGR conduit provided with the EGR valve assembly of the previously and subsequently described embodiment, an air filter and a compressor. The air filter and the compressor are connected respectively to the inlet and the outlet of the duct. This embodiment has the advantage that the air duct may be configured independently of the EGR valve.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
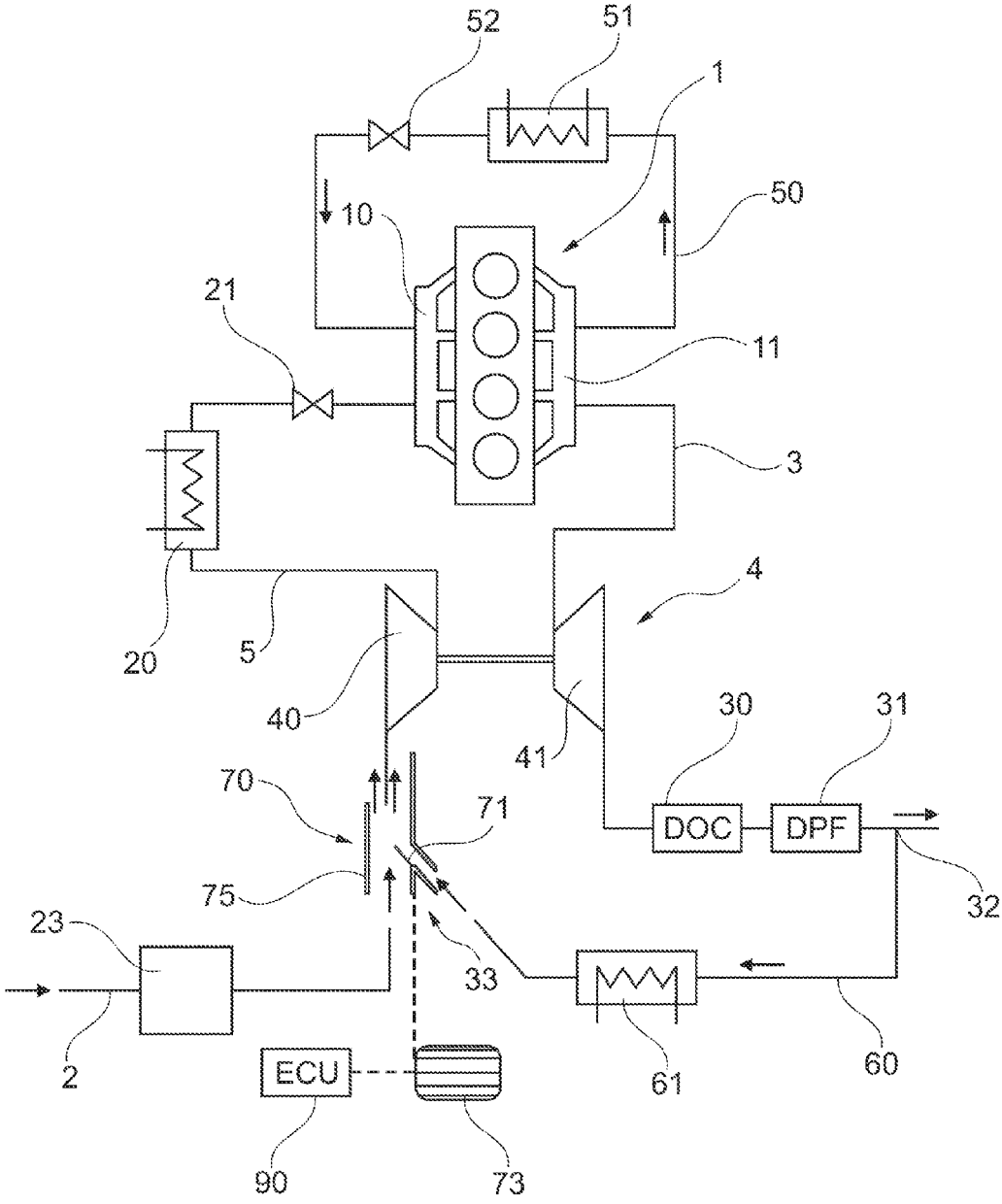
FIG. 1 schematically illustrates a turbocharged internal combustion engine provided with a long route EGR valve assembly according to an embodiment.
Figure 3:
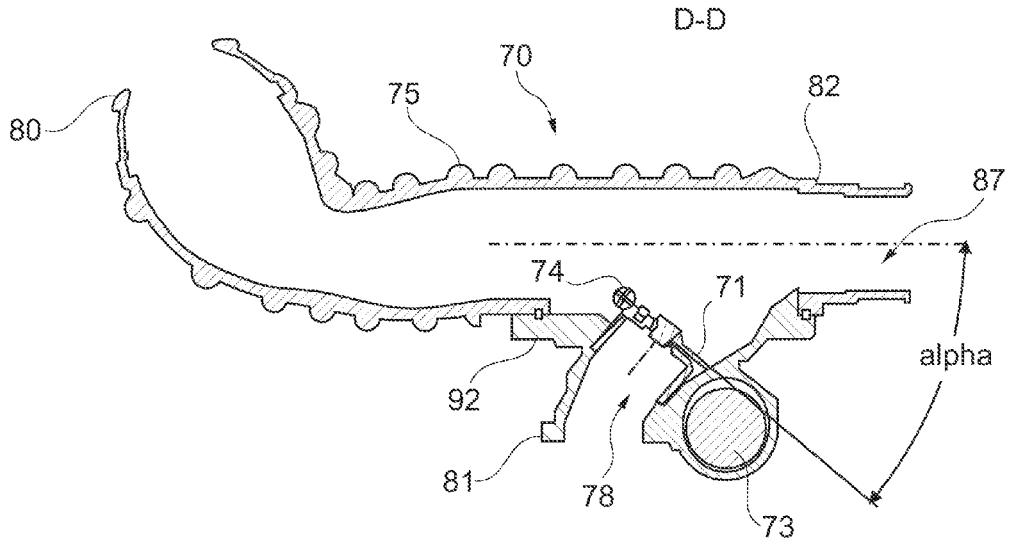
FIG. 3 is a cross section of the EGR valve assembly according to line D-D of FIG. 2.
Figure 2:
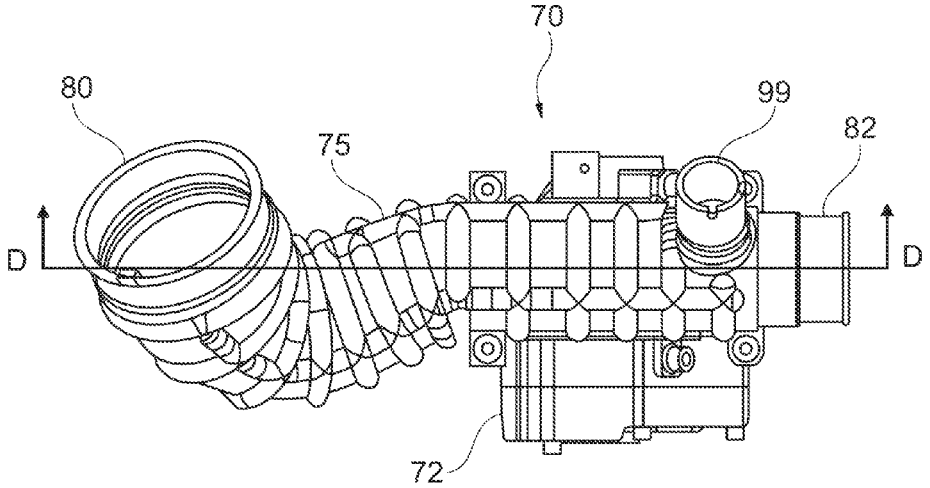
FIG. 2 is a first view of an EGR valve assembly according to an embodiment.
Figure 4:
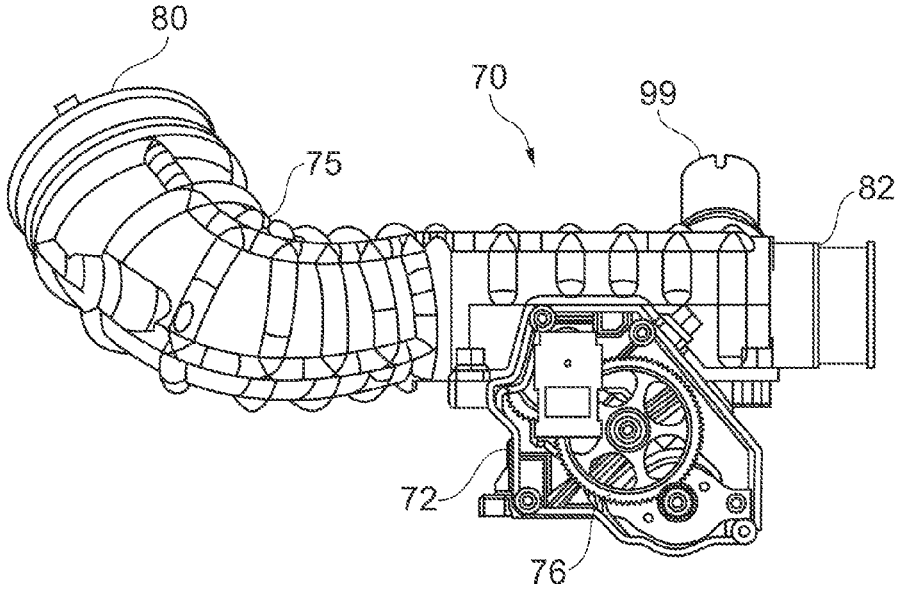
FIG. 4 is a second view of an EGR valve assembly according to an embodiment showing internal mechanisms thereof.
Figure 5:
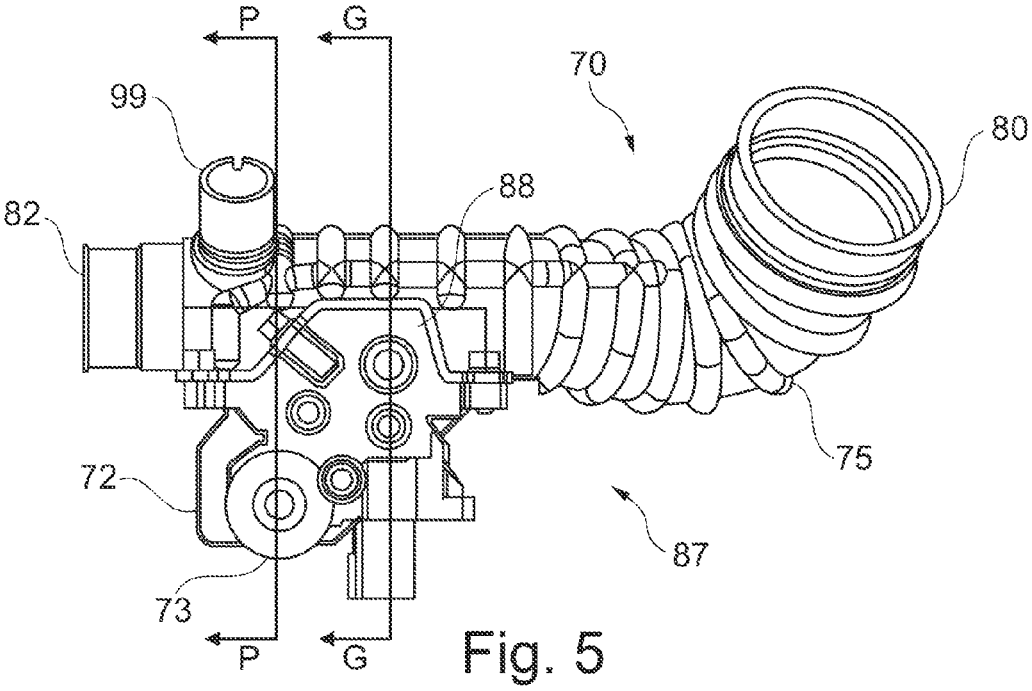
FIG. 5 is a third view of an EGR valve assembly according to an embodiment.
Figure 6:
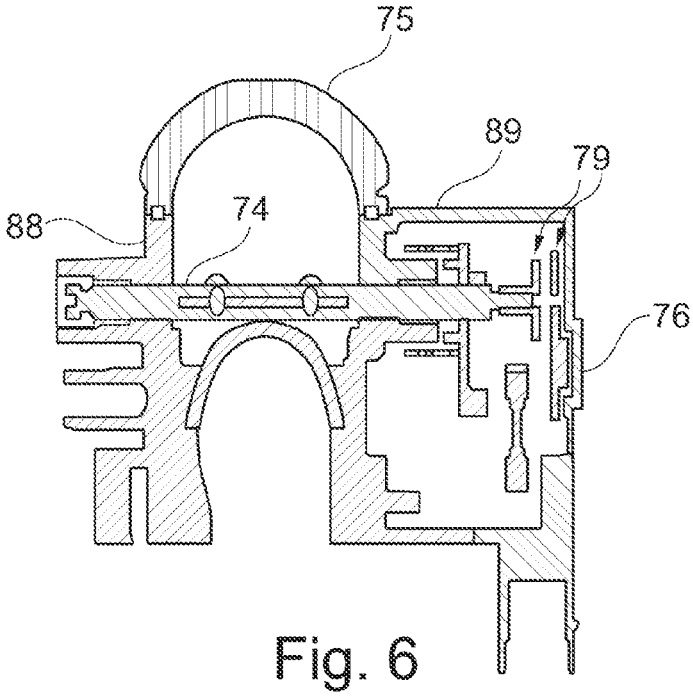
FIG. 6 is a cross section of an EGR valve assembly according to line G-G of FIG. 5.
Figure 7:
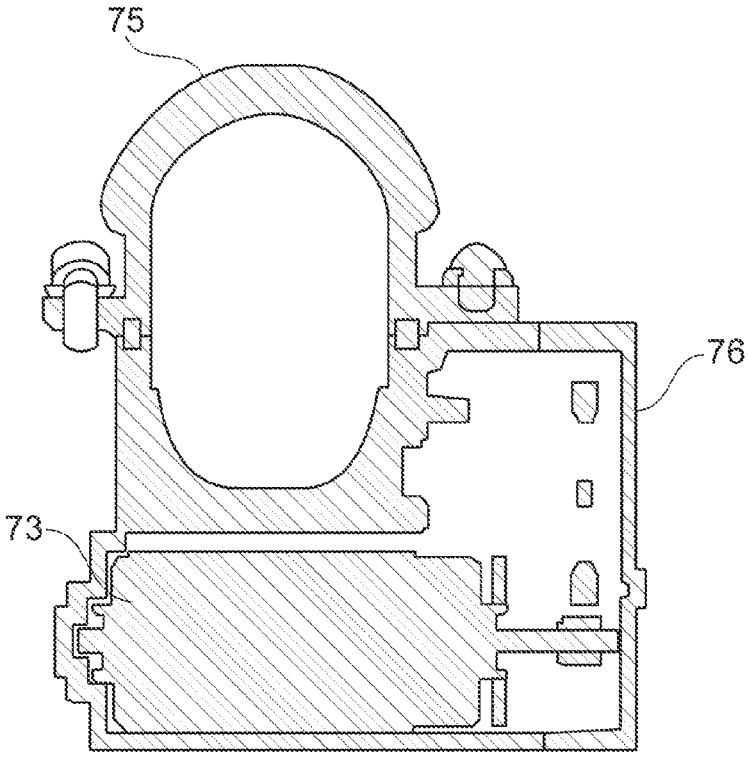
FIG. 7 is a cross section of an EGR valve assembly according to line P-P of FIG. 5.
Figure 8:
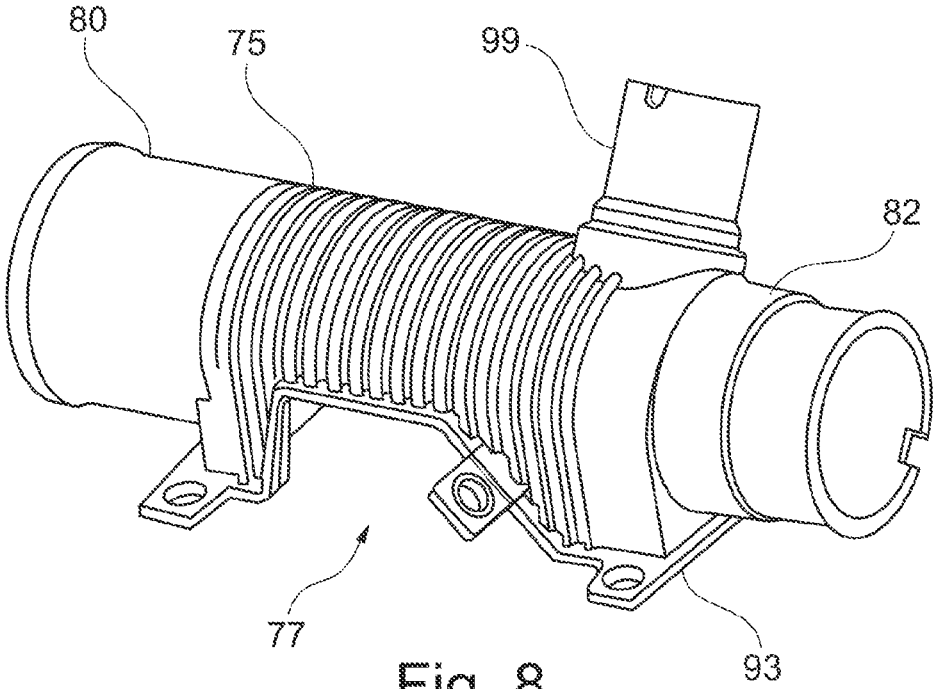
FIG. 8 is an axonometric view of an embodiment of a duct of the EGR valve assembly.
Figure 9:
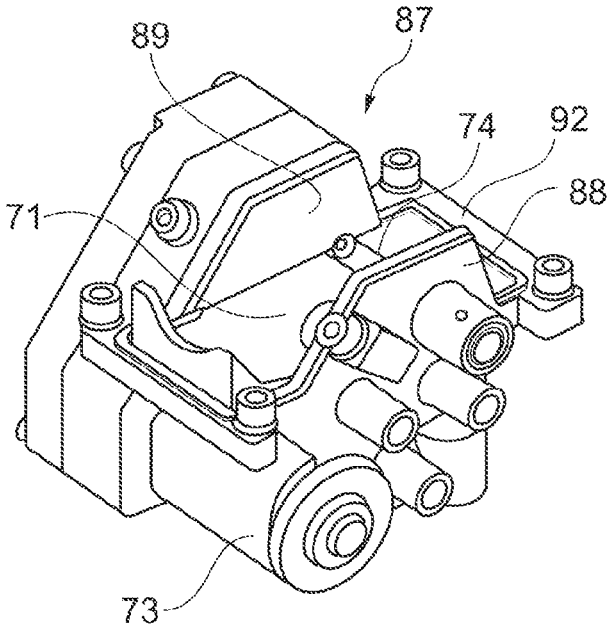
FIG. 9 is an axonometric view of an embodiment of a valve housing for the EGR valve assembly according to an embodiment.

The following detailed description is merely exemplary in nature and is not intended to limit application and uses. Furthermore, there is no intention to be bound by any theory presented in the preceding background or summary or the following detailed description.

The internal combustion engine 1 is equipped with an intake manifold 10, an exhaust manifold 11, an environmental air conduit 2 for feeding fresh air from the environment, through an intake pipe 5, into the intake manifold 10, an exhaust pipe 3 for discharging the exhaust gas from the exhaust manifold 11 into the environment, and a turbocharger 4 which comprises a compressor 40 located in the intake pipe 5, for compressing the air stream flowing therein, and a turbine 41 located in the exhaust pipe 3, for driving the compressor 40.

The engine 1 is also equipped with an intercooler, also referred as Charge Air Cooler (CAC) 20, located in the intake pipe 5 downstream the compressor 40, for cooling the air stream before it reaches the intake manifold 10, and a valve 21 located in the intake pipe 5 between the CAC 20 and the intake manifold 10. The engine 1 is further equipped with a diesel oxidation catalyst (DOC) 30 located in the exhaust pipe 3 downstream the turbine 41, for degrading residual hydrocarbons (HC) and carbon oxides (CO) contained in the exhaust gas, and a diesel particulate filter (DPF) 31 located in the exhaust pipe 3 downstream the DOC 30, for capturing and removing diesel particulate matter (soot) from the exhaust gas.

In order to reduce the emission of nitrogen oxides ($NO_x$), the engine 1, which in this example is a turbocharged Diesel engine comprises an exhaust gas recirculation (EGR) system, for routing back and feeding exhaust gas into the intake manifold 10. The EGR system comprise a first short-route or High Pressure EGR conduit 50 for fluidly connecting the exhaust manifold 11 directly with the intake manifold 10, a first EGR cooler 51 located in the first EGR conduit 50, for cooling the exhaust gas flowing therein, and a first electrically controlled valve 52 located in the first EGR conduit 50, for regulating the flow rate of exhaust gas through the first EGR conduit 50. The EGR system further comprise a second long-route or Low Pressure EGR conduit 60, which fluidly connects a first linking point 32 of the exhaust pipe 3 with a second linking point 33 of the intake pipe 5, and a second EGR cooler 61 located in the second EGR conduit 60, for cooling the exhaust gas flowing therein.

The first linking point 32 of the exhaust pipe 3 is located downstream the DPF 31, while the second linking point 33 of the intake pipe 5 is located downstream an air filter 23 and upstream the compressor 40. The flow rate of exhaust gas through the long-route EGR conduit 60 is determined by an electrically controlled three-way valve 78, which is located in the second linking point 33 of the intake pipe 5 and is provided with a flap 71 to regulate the flow.

The three-way valve 78 is part of a long route EGR valve assembly 70 that comprises a duct 75 having an inlet 80 which is connected to an outlet of the air filter in order to receive filtered air coming from the environment and an outlet 82 that is connected to the inlet of the compressor 40. The duct 75 is also equipped with a seat 99 for a Mass Air Flow (MAF) sensor. The duct 75 is also configured with an open section 77 that defines a seat for a EGR valve housing 72 that houses the valve 78. In conjunction with that feature, the EGR valve housing 72 is provided with an engaging portion 87 configured to seal the open section 77 of the duct 75. Furthermore, the engaging portion 87 of the EGR valve housing 72 comprises a first wing 88 and an opposing second wing 89 that configure a part of the open section of the duct 75. According to this embodiment, the EGR valve housing 72 contributes to define a sealed portion of the air duct 75 when it is mounted on it.

In order to allow an easy mounting of the valve assembly 70, the valve housing 72 comprises a first flange 92 connected to a second flange 93 of the duct 75. The housing 72 also accommodates a DC motor 73 and a series of gears 76 that act on a valve shaft 74 in order to operate a valve flap 71 of the valve 78. The housing 72 is also configured in order to have an inlet 81 that is connected to the Low Pressure EGR conduit 60 and receives exhaust gas from it. The combination of the duct 75 and of the housing 72 with the valve 78 provides the Long route EGR valve assembly 70.

The Electronic Control Unit (ECU) 90 of the engine system controls the position of the flap 71 in order to regulate pressure and flow of air and gas coming from the long route EGR circuit 60 and entering first into inlet 81 of housing 72 and then reaching the flap 71. A contactless position sensor 79 is able to measure the flap shaft 74 rotation. The duct 75 may be made of any kind of plastic material suitable to withstand the gas temperatures normally present in such duct and able to create a damping effect in the region between the vehicle chassis and the compressor connected to the motor thus effectively reducing vibrations. Furthermore, the plastic duct 75 may be molded in different shapes to adapt to different air quantity requirements. The use of a plastic material reduces valve assembly overall weight.

According to the embodiment described, the three-way EGR valve 78 described, the DC motor 73 and the gears 76 that act on the valve flap 74 can be common for different engine application and the EGR valve housing, when mounted on the duct 75, seals its open portion. The three-ways EGR valve assembly 78 substitutes throttle body and an EGR valve commonly used in Low pressure EGR system in one single component. Also, in the three-way EGR valve housing, the air and gas will be mixed immediately upstream the compressor. Since the housing 72 position is below the duct 75, it can be easily connected to the long route EGR cooler water circuit to prevent overheating of the DC motor 73.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

What is claimed is:

1. An exhaust gas recirculation (EGR) valve assembly for an Internal Combustion Engine, the EGR valve assembly comprising:

a duct having an inlet and an outlet, wherein a portion of the duct includes an open section; and a valve housing that is separate from the duct and connected to the duct, the valve housing having a passage that leads into the duct, the valve housing comprising: an engaging portion, and a valve flap that is configured to open and close the passage; and wherein the open section of the duct defines a seat for the valve housing, and wherein the engaging portion of the valve housing is configured to seal the open section of the duct.

2. The EGR valve assembly according to claim 1, wherein the engaging portion comprises:

a first wing; and a second wing that opposes the first wing, wherein the valve flap is disposed between the first wing and the second wing, and wherein the first wing and the second wing are configured to mate with the open section of the duct.

3. The EGR valve assembly according to claim 1, wherein the valve housing is configured to accommodate an actuator configured to actuate the valve flap.

4. The EGR valve assembly according to claim 3, wherein the valve housing is further configured to accommodate a series of gears connecting the actuator to the valve flap.

5. The EGR valve assembly according to claim 3, further comprising a position sensor configured to measure a position of the valve flap.

6. The EGR valve assembly according to claim 1, wherein the valve housing comprises a first flange connected to a second flange of the duct.

7. The EGR valve assembly according to claim 1, wherein the duct is equipped with a second seat for a Mass Air Flow (MAF) sensor.

8. The EGR valve assembly according to claim 1, wherein the duct is at least partly made of plastic material.

9. An intake line for an Internal Combustion Engine comprising:

an exhaust gas recirculation (EGR) conduit;

an EGR valve assembly, comprising:

a duct having an inlet and an outlet, wherein a portion of the duct includes an open section, a valve housing that is separate from the duct and connected to the duct, the valve housing having a passage that leads into the duct, the valve housing comprising: an engaging portion, and a valve flap that is configured to open and close the passage;

wherein the open section of the duct defines a seat for the valve housing; and wherein the engaging portion of the valve housing is configured to seal the open section of the duct;

an air filter; and a compressor, wherein the air filter and the compressor are connected respectively to the inlet and the outlet of the duct.

10. The intake line according to claim 9, wherein the engaging portion comprises:

a first wing; and a second wing that opposes the first wing, wherein the valve flap is disposed between the first wing and the second wing, and wherein the first wing and the second wing are configured to mate with the open section of the duct.

11. The intake line according to claim 9, wherein the valve housing is configured to accommodate an actuator configured to actuate the valve flap.

12. The intake line according to claim 11, wherein the valve housing is further configured to accommodate a series of gears connecting the actuator to the valve flap.

13. The intake line according to claim 11, further comprising a position sensor configured to measure a position of the valve flap.

14. The intake line according to claim 9, wherein the valve housing comprises a first flange connected to a second flange of the duct.

15. The intake line according to claim 9, wherein the duct is equipped with a second seat for a Mass Air Flow (MAF) sensor.

16. The intake line according to claim 9, wherein the duct is at least partly made of plastic material.

* * * * *